United States Patent [19]

Davis

[11] Patent Number: 5,039,151

[45] Date of Patent: Aug. 13, 1991

[54] SNOW SHOVEL

[76] Inventor: Edgar H. Davis, 4320 Britannia Drive, Calgary, Alberta T2S 1J5, Canada

[21] Appl. No.: 410,043

[22] Filed: Sep. 19, 1989

[30] Foreign Application Priority Data

Sep. 20, 1988 [CA] Canada ..... 577896

[51] Int. Cl.[5] ..... E01H 5/02

[52] U.S. Cl. ..... 294/54.5; 294/49; 294/56

[58] Field of Search ..... 294/49, 51, 53.5–55, 294/56–60; 15/257.1, 257.9; 37/118 R, 122, 130, 141 R, 264–266, 278, 285; 254/131.5

[56] References Cited

U.S. PATENT DOCUMENTS

| | | | |
|---|---|---|---|
| D. 34,323 | 4/1901 | Williams . | |
| 245,046 | 8/1881 | Ball | 37/118 R |
| D. 267,468 | 1/1983 | Simms | 294/54.5 X |
| 268,669 | 12/1882 | Heiser | 294/55 X |
| 366,099 | 7/1887 | Hinchman | 294/56 |
| 525,149 | 8/1894 | Lemieux | 294/55 |
| 996,621 | 7/1911 | Danielson | 294/49 |
| 1,046,616 | 12/1912 | Loftsgaarden | 294/49 X |
| 1,423,775 | 7/1922 | Mundt . | |
| 1,799,204 | 4/1931 | Wily . | |
| 2,312,736 | 3/1943 | Schmal | 294/55 |
| 2,919,153 | 12/1959 | Benton . | |
| 2,930,152 | 3/1960 | Pipkin | 294/54.5 X |
| 2,969,120 | 1/1961 | Randolph . | |
| 3,078,604 | 2/1963 | Neuman . | |
| 3,177,026 | 4/1965 | Cowan | 294/54.5 |
| 4,149,744 | 4/1979 | Bonnes . | |
| 4,632,441 | 12/1986 | Dunlap . | |

FOREIGN PATENT DOCUMENTS

| | | | |
|---|---|---|---|
| 106476 | 6/1908 | Canada . | |
| 184329 | 5/1918 | Canada . | |
| 320494 | 3/1932 | Canada . | |
| 46502 | 1/1980 | Canada . | |
| 280121 | 4/1952 | Switzerland | 15/257.9 |
| 1062829 | 3/1967 | United Kingdom | 294/54.5 |

*Primary Examiner*—Johnny D. Cherry

*Attorney, Agent, or Firm*—Stevens, Davis, Miller & Mosher

[57] ABSTRACT

A snow shovel is disclosed which combines the straight transverse front or leading edge with the shape of a shallow scoop which forms a major part of the front face of the scoop of the shovel. The advantage is in that the shoveled snow tends to accumulate at the center of the scoop thus reducing the spill over the sides of the shovel and also facilitating the manipulation of the shovel filled with snow. The geometry of the handle is designed to facilitate the manipulation of the shovel.

11 Claims, 3 Drawing Sheets

FIG. 5
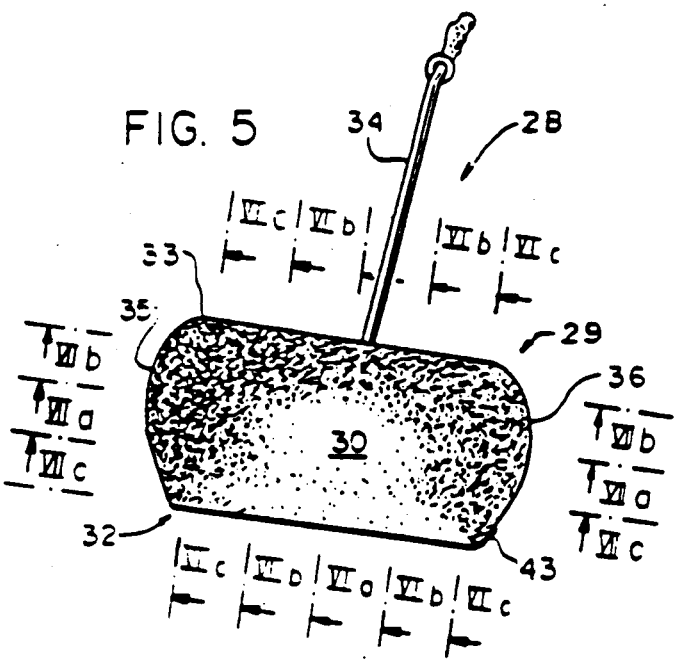
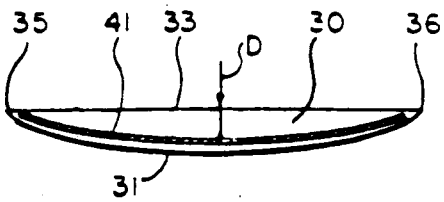
FIG. 7b
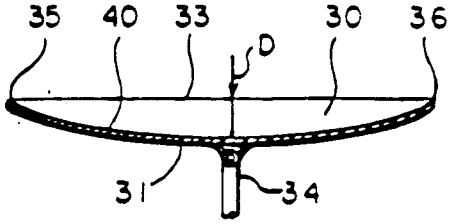
FIG. 7a
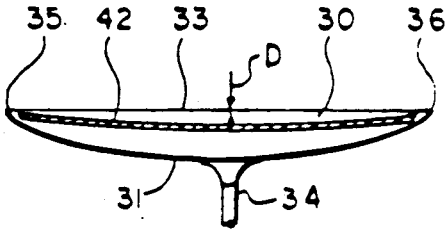
FIG. 7c
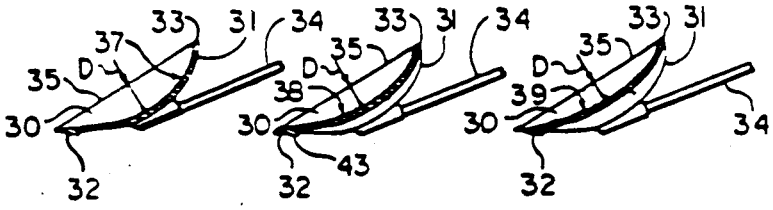
FIG. 6a FIG. 6b FIG. 6c
FIG. 8
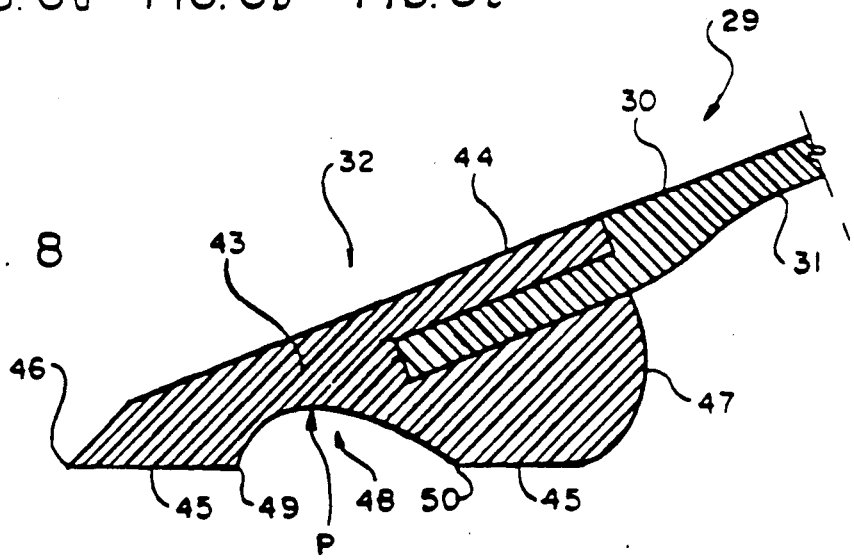

SNOW SHOVEL

BACKGROUND OF THE INVENTION

1. Field of the Invention

The present invention relates to the art of snow shovels and in particular to the snow shovel scoops.

Snow shovels have a distinctly different purpose from other types of shovels or spades. The difference is dictated by the material which is to be handled by the particular tool. While regular shovels are designed for work with relatively heavy particulate material, snow shovels have to handle often very light, fluffy snow. The principal task of a snow shovel is to allow scraping the surface of a driveway, sidewalk or the like free of snow which task necessitates the structure allowing as wide a strip as possible to be cleaned at a single pass. The ease of regular shoveling in the sense of lifting and moving the material is of a secondary significance even though it is far from being insignificant. This, in turn, results in a basic structural difference between the show shovel blade and the blade of other shovels, namely the ratio of the width of the blade to its length. Snow shovel blades are normally of a width which is substantially greater than the length.

2. Description of the Prior Art

FIG. 1 shows a snow shovel as described in U.S. Pat. No. 2,919,153. It has a flat, planar scoop 10 of a generally trapezoidal outline and is formed with a forwardly disposed work-engaging face 11 and a rear section 12 to which is fixedly secured a handle 13 at a mounting bracket 14 which is integral with the rear section 12. The leading edge 15 and the trailing edge 16 of the shovel shown in FIG. 1 are both bent away from the plan of the main portion of the front face 11 of the shovel. When viewed from the standpoint of the present invention, the disadvantage of this shovel is mainly in that a substantial spill at both sides of the shovel is likely to occur and that the capability of the shovel to accumulate a substantial volume of snow on the scoop itself is also hampered due to the planar arrangement of the shovel scoop. Therefore, the scoop is most likely to provide a spill not only on the sides of the shovel but also over the trailing edge 16 before a reasonable volume of snow has accumulated on the surface 11.

FIG. 2 which corresponds to the arrangement of U.S. Pat. No. 3,078,604 (Neuman) presents an improvement over the first mentioned prior art reference in that the scoop 17, to which a handle 18 is secured, displays a concave curvature in longitudinal direction. This curvature aids the accumulation of snow during the shoveling and in most instances effectively prevents the spill of snow over the trailing edge 19 of the scoop. However, the disadvantage of the spillage of snow at both opposed side sections 20, 21 is still present.

Attempts have been made in the art of snow shovels to limit the spillage at the sides sections of the shovel scoop. An example of the known solutions is presented by U.S. Pat. No. 4,149,744 issued to Bonnes. Shown here in FIG. 3, the shovel scoop 22 is provided with a continuous upwardly directed flange having a first portion 23 disposed at one side of the scoop, a second portion 24 at the trailing end of the scoop and a third portion 25 at the opposed side section of the scoop 22. The flange 23, 24, 25 is only marginally effective since the arrangement of the front face 26 is generally planar despite a number of reinforcing ribs such as rib 27. The reinforcing ribs prevent the snow moving transversely on the shovel and thus prevent heaping of the snow in the centre of the shovel to inhibit spilling. Accordingly, the avoidance of spillage by this third type of a snow shovel is also merely marginal as the shovel in effect presents only a very minor improvement in handling of snow when compared with the arrangement of, say, FIG. 1.

SUMMARY OF THE INVENTION

It is an object of the present invention to provide a snow shovel which would be simple to produce and which would provide an improved efficiency in snow shoveling.

In general terms, the invention provides a snow shovel scoop, or a snow shovel, comprising a front face section, a rear surface section, two opposed side sections, a straight, transverse forward edge section and a generally transversely oriented rear edge section, the length of said forward edge section being greater than a maximum length of said scoop as measured between opposed points of the forward edge section and the rear edge section, the front face section having the configuration of a generally concave surface, said generally concave surface being concavely arched both in longitudinal direction and in transverse direction, said generally concave surface forming a major area of the front face section, the forward edge section including a transverse bar having a wedge-shaped cross-section, said bar having a generally planar ground engagement underside, a linear, acute-angled leading edge, and a rearwardly and upwardly curved heel section parallel with the leading edge and forming a rear limit of the underside, the underside being recessed at a transverse channel extending the entire length of the bar, said channel being parallel with the leading edge and being disposed between said leading edge and the heel section.

Preferably the cross-section of the transverse channel is arcuate, the depth of the channel being at its maximum at a point which is offset towards the leading edge. According to another preferred feature, the heel section forms a downwardly protruding step-like joinder between the underside of the bar and that portion of the rear surface section which is adjacent to the bar, whereby the portion of the rear surface section adjacent to the transverse bar is maintained above the ground when the shovel is in use. In a still further preferred embodiment, the cross-section of the transverse channel is arcuate, the depth of the channel being at its maximum at a point which is offset towards the leading edge.

BRIEF DESCRIPTION OF THE DRAWINGS

In the drawings:

FIG. 5 is a diagrammatic representation of the shovel according to the present invention;

FIGS. 6*a*, 6*b* and 6*c* are sectional views taken along the lines VIa, VIb and VIc, respectively, of FIG. 5;

FIGS. 7*a*, 7*b* and 7*c* are sections VIIa, VIIb and VIIc, respectively, of FIG. 5;

FIG. 8 is a longitudinal section of a forward edge section of the shovel scoop shown in FIG. 5, as viewed along any of the longitudinal sectional lines of VIa–VIc indicated in FIG. 5;

DESCRIPTION OF THE PREFERRED EMBODIMENTS

Figure 1:
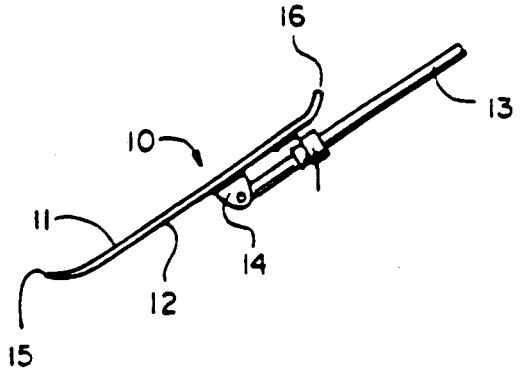
FIG. 1 (PRIOR ART)
FIG. 1 is a side view of a prior art shovel.
Figure 2:
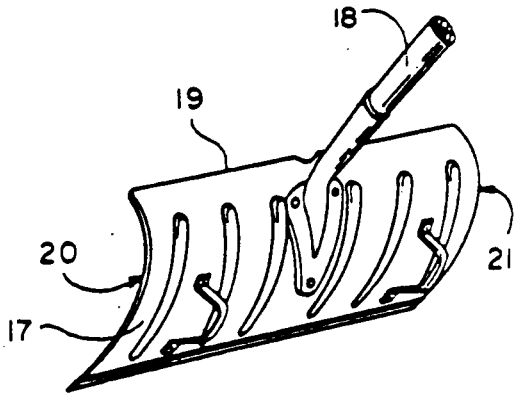
FIG. 2 (PRIOR ART)
FIG. 2 is a perspective view of another prior art snow shovel.
Figure 3:
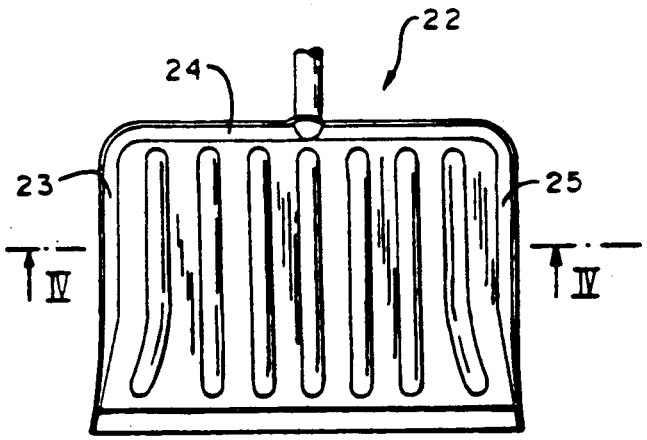
FIG. 3 (PRIOR ART)
FIG. 3 is a plan view of a third kind of prior art shovel.
Figure 4:
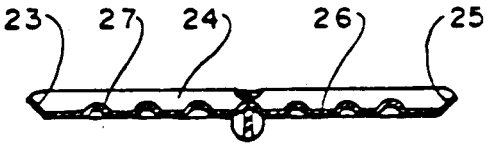
FIG. 4 (PRIOR ART)
FIG. 4 is a section IV—IV of FIG. 3.

The invention will now be described by way of a preferred, exemplary embodiment with reference to the diagrammatic representations contained in FIGS. 5, 6, 7 and 8.

The snow shovel 28 comprises a scoop 29. As is usual in shown shovel scoops, the scoop includes a front face section 30 and a rear surface section 31. At the front of the scoop 29 is a straight, transverse leading edge section 32 and at the back is a trailing or rear edge section 33.

In the embodiment shown, the rear edge section 33 is also straight and transverse. However, it can be also of a different configuration, for instance rounded, whereby it could only be referred to as being generally transversely oriented.

Figure 9:
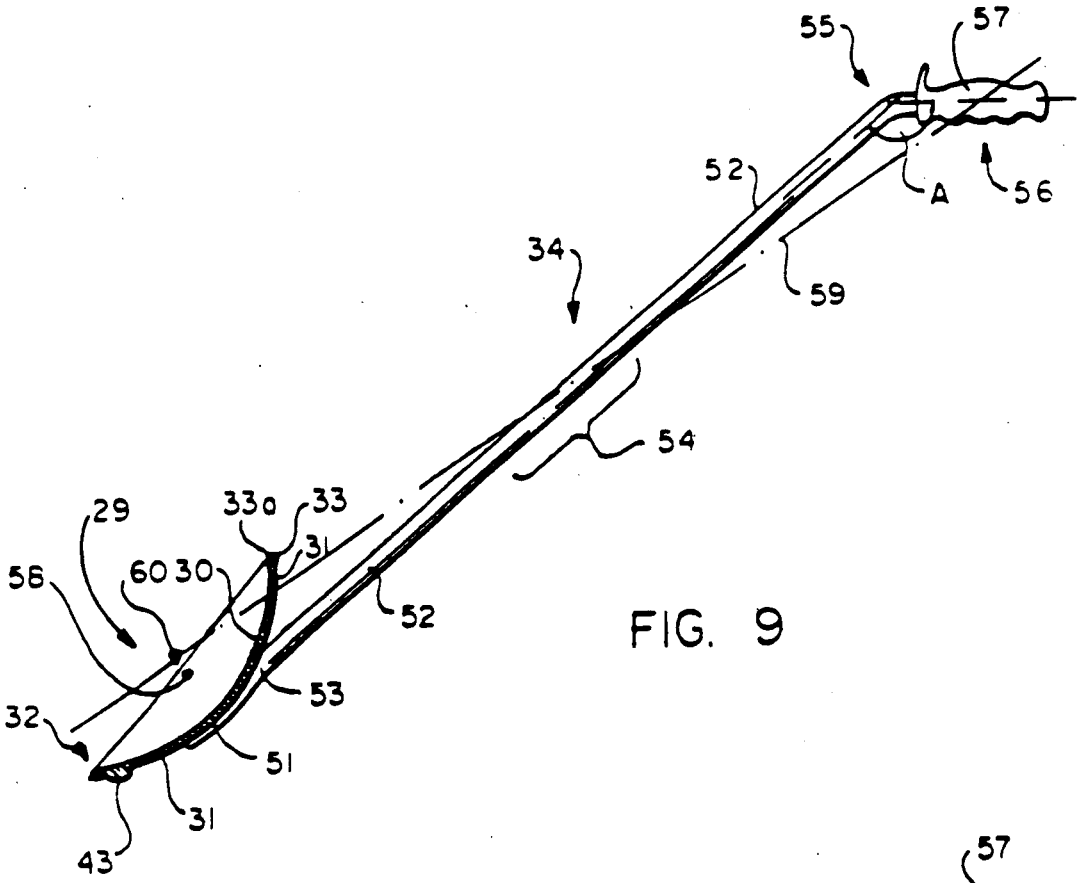
FIGS. 9 and 10 are diagrammatic representations of a side view of the shovel with the scoop empty and fully loaded, respectively, showing the geometry of the handle of the shovel.
Figure 10:
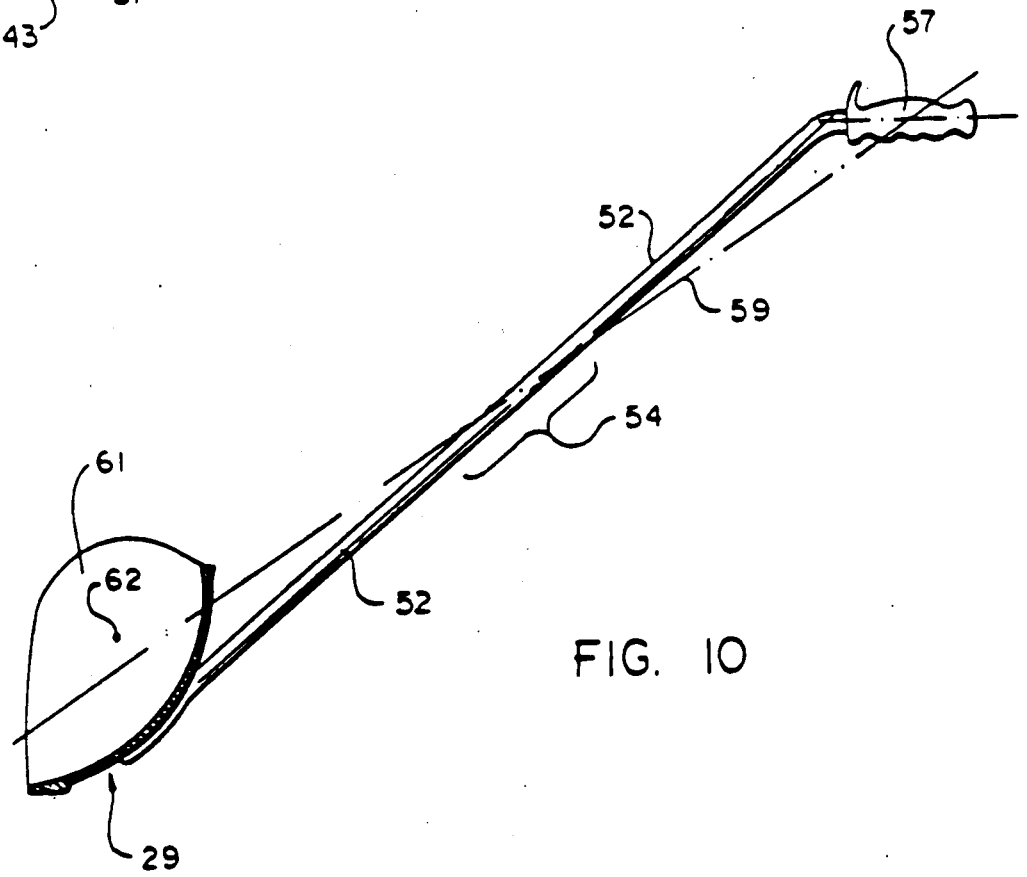

As best shown in FIGS. 9 and 10, the rear edge section 33 includes a trailing edge 33*a* and a gradually thickened adjacent portion of the scoop. In other words, the thickness of the scoop is increased at the rear edge section 33, to provide a scraping edge 33*a* for snow removal from boots. Besides, the thickening adds stiffness to the scoop.

An elongated handle means 34 is fixedly secured to the scoop 29 and extends rearwardly away from the rear surface section 31 in a fashion well known in the art, for instance in the above Neuman patent. The front face 30 of the scoop has the configuration of a generally concave surface which is concavely arched both in longitudinal direction (which generally coincides with the direction of the handle means 34 and also of the sectional lines VIa–VIc). The generally concave surface 30 extends virtually from one edge of the scoop to the other in both directions and in any event forms a major area of the front face section 30. The front face section 30 is limited on its sides by two opposed side sections 35, 36.

The generally concave shape is so referred to because the curvature of the cavity formed by the front face 30 is different in transverse and longitudinal directions, as will be apparent from the following discussion based on the sectional views of FIGS. 6*a*–6*c*.

The section lines VIa, VIb and VIc represent a few of infinite number of what is referred to as "first reference planes". It can be seen on examining FIG. 5 that the first reference plane, for instance, plane VIa, intersects the front face 30 and is therefore a plane of intersection. It is also perpendicular to the leading edge section 32. The same definition applies to any of the sections VIb, VIc and to an infinite number of generally longitudinally oriented first reference planes.

Turning now to FIGS. 6*a*–6*c* it can be seen that the hatched cross-sectional parts shown in those drawings and representative of the shape of the scoop 29 at a particular first reference plane, define cross-sectional curves which are referred to as "first cross-sectional curves". Thus, in FIG. 6*a*, there is shown a first cross-sectional curve 37 which is arched and which is relatively deep. Another first cross-sectional curve 38 is shown in FIG. 6*b*. It can be seen on comparing the first cross-sectional curve 38 with the first cross-sectional curve 37, that in case of curve 38, the depth is lower. The depth of the first cross-sectional curve 39 shown in FIG. 6*c* is even shallower. The different depth of the first cross-sectional curves 37, 38 and 39 is due to the concave curvature of the scoop 29 which will be referred to later. For the time being, attention is directed to the fact that each of the first cross-sectional curves 37, 38, 39 extends from the leading edge section 32 all the way to the rear or trailing edge section 33.

It can be readily appreciated that the difference between the configuration of the first cross-sectional curves 37, 38, 39 is different from the arrangement of Neuman, U.S. Pat. No. 3,078,604 in that the Neuman shovel scoop would produce the same depth of each of the first cross-sectional curves 37, 38, 39. Defining the first cross-sectional curves generally and referring to their length, it can be said that they extend each from a region near the leading edge section to a region near the rear edge section, it being understood that both the leading edge section and the rear edge section may have a modified configuration if required.

FIGS. 7*a*–7*c* show the shape of the scoop in second transverse reference planes of intersection. These planes can be defined as being parallel with the leading edge section 32 and being disposed at right angles to a longitudinal axis of the scoop. The longitudinal axis of the scoop corresponds generally but not exactly to the axis of elongation of handle means 34. If handle means 34 were replaced by another, modified arrangement of the handle, for instance by a U-shaped handle, then the general direction of elongation of such handle would still be the same as in case of a simple handle means 34. In FIG. 7*a*, a second arched cross-sectional curve 40 presents the deepest arched curvature of the second cross-sectional curves. The second cross-sectional curve 41 shown in FIG. 7*b* shows a somewhat shallower arrangement while the second cross-sectional curve of FIG. 7*c*, designated with reference number 42, is very shallow as it is disposed very close to the linear rear edge section 33.

In order to more clearly describe the configuration of the generally concave surface 30, the following exemplary figures present a representative arrangement of the shovel. For the sake of clarity, it should be first pointed out that the side sections 35, 36, the rear edge section 33 and the leading edge section 32 can be all assumed to be within a single plane of reference. The depth of the generally concave scoop therefore can be measured from such reference plane which is designated with reference numbers 32, 33, 35 and 36, depending which view one considers. The maximum depth D of the concave shape is shown in FIG. 6*a* and is approximately 75 millimeters. The same maximum depth D is present at the centre of the second curve shown in FIG. 7*a*. In FIG. 6*b*, the depth D is approximately 60 millimeters.

The reduction in the depth D in the remaining FIGS. 7*b* and 7*c* and 6*b* and 6*c* is generally proportional to the figures given above.

On the other hand, the curvature is not shown exactly in proportion with respect to the overall width of the scoop which is approximately 530 millimeters. The length of the scoop, i.e. the distance between the rear edge section 33 and front edge section 32 in the embodiment shown, is approximately 300 millimeters.

According to another feature of the present invention and referring particularly to FIG. 8, it can be seen that the scoop 29 is provided, at its leading edge section 32, with a transverse bar 43. The top surface 44 of the transverse bar 43 is generally flush with the surface of the front face 30. The bar 43 displays a generally wedge-shaped cross-sectional configuration. It has a generally planar ground engagement underside 45, a linear, acute angled leading edge 46 and a rearwardly and upwardly curved heel section 47, which extends parallel with the forward edge, transversely of the scoop and forms a rear limit of the underside 45.

The underside 45 is recessed at a transverse channel 48 which extends the entire length of the bar, i.e. the entire width of the scoop at the leading edge section 32. The channel is also linear and extends in parallel with the leading edge 46. It is disposed between the leading edge 46 and the heel section 47.

The cross-sectional configuration of the transverse channel is arcuate, the arch of the cross-section being such that the depth of the panel is at its maximum at a point P which is offset towards the forward edge 46, the point being closer to the left hand margin 49 of the channel 48 than to trailing margin 50 of the channel 48.

Due to the concave surface of the entire scoop, the scoop exhibits an improved inherent strength which eliminates the need for reinforcement ribs such as shown in the prior art referred to above. Moreover, the inherent strength also facilitates the production of the scoop from a suitable impact proof plastic. The transverse bar 43 is also made of a friction resistant plastic material.

In operation, the shovel is held by the handle means 34 such that the underside 45 slides along the surface. The heel section 47 which protrudes stepwise from the underside 45 keeps the underside spaced above the ground. Due to the arrangement of the transverse channel 48, the operator of the shovel has the "feel" of the correct position of the underside 45 which contributes to a continuous self-sharpening effect at edge 46 as the shovel wears down. The curved shape of the heel section 47 makes it convenient to overcome minor objections that may stay in the path of the shovel when in use. The shape of the scoop contributes to the snow accumulating primarily in the centre of the scoop at which a slight compacting of the snow takes place. This effect has a beneficial result in that the snow is accumulated at the centre of the scoop thus reducing the spill of snow on the sides 35, 36 and at the rear edge section 33 of the scoop, with the overall result that the number of passes one has to make with the shovel to clean a given area can also be reduced, particularly when the snow is light and not too deep.

Reference should now be had to FIGS. 9 and 10 which show, in a diagrammatic fashion, a side view of an exemplary embodiment of the shovel according to the present invention. It is to be understood that the side view is limited to the features which are associated with the handle means 34 and with its geometry which will now be described in greater detail.

The handle means in the shown embodiment is a simple handle which is fixedly secured to the rear surface 31 of the scoop 29 at point 51 which is disposed centrally between the side edges of the scoop 29. The handle or handle means 34 comprises a generally straight stem 52. The first end portion 53 of the stem 52 generally coincides with the rear surface 31 of the scoop 29 where it is fixedly secured as usual. There is a generally central portion of the stem 52 which is designated with reference number 54 and which is normally grasped by one hand of the user of the shovel. Reference numeral 54 thus designates what is referred to as a "first hand grip portion".

The second end portion 55 of the stem 52 has an angular extension 56 which is provided with a suitable hand grip 57. The part 56 thus forms a second hand grip section. It extends rearwardly of the shovel at an obtuse angle A to the stem 52 such that when the shovel is in its working position with the front edge 32 resting on the ground (as shown in FIGS. 9 and 10), the second hand grip section 57 is generally horizontal.

It is shown in the diagrammatic representations of FIGS. 9 and 10 that the cavity of the scoop 29 has an imaginary centre of gravity which is referred to as "a first centre of gravity 58". It will be appreciated in this context that the term "centre of gravity of the cavity" is to be interpreted as having the meaning of the centre of gravity of an imaginary shell which would correspond in shape and size to the configuration and size of the cavity of the scoop 29.

In the drawings of FIGS. 9 and 10, an imaginary line 59 is shown as passing through the two hand grip sections 57 and 54. At the lower left of FIGS. 9 and 10, the line 59 is shown as extending above the centre of gravity 58 and intersecting the scoop 29. This arrangement adds to the convenience of handling the shovel as in the empty state (FIG. 9) the centre of gravity of the cavity of the scoop 29 is below reference line 59 adding to the convenience of handling of the shovel.

The relationship between the reference line 59 and the centre of gravity 58 can also be expressed by stating that a reference point 60 of the line 59, which is closest to the centre of gravity 58, is disposed at a level which is above the level of the point of gravity 58 when the shovel is in its working position as shown in FIGS. 9 and 10.

In FIG. 10, the representation is virtually identical with that of FIG. 9 but shows the scoop 29 of the shovel fully loaded with a load 61 of snow. The snow is assumed to be of regular density and weight and is not presumed to be extremely heavy, wet snow such as is encountered at the beginning and end of winter time, or extremely light. The centre of gravity of the load 61 is referred to as another point 62. It is shown in FIG. 10 that the shape and overall disposition of the handle stem 52 and of its hand grip sections 54, 57 are so selected that the reference line 59 passes underneath the point of gravity 62. This results in that, when a full scoop is raised with the user's hands holding the hand grip sections 57, 54, the shovel can be relatively easily tilted to one side or to the other, regardless of the fact that the snow has accumulated in the centre of the scoop 29. This adds to the convenience of manipulating the shovel, particularly when used to clear a relatively deep layer of snow.

Those skilled in the art will readily appreciate that many modifications of the shape of the scoop of a snow shovel of the present invention can be effected utilizing the basic idea of the present invention. Accordingly, I wish to secure by letters patent which may issue on this application all such embodiments which properly fall within the scope of my contribution in the art.

What is claimed is:

1. A snow shovel scoop comprising a front face section, a rear surface section, two opposed side sections, a straight, transverse forward edge section and a generally transversely oriented rear edge section, the length of said forward edge section being greater than a maximum length of said scoop as measured between opposed points of the forward edge section and the rear edge section, the front face section having the configuration of a generally concave surface, said generally concave surface being concavely arched both in longitudinal direction and in transverse direction, said generally concave surface forming a major area of the front face section, the forward edge section including a transverse bar having a wedge-shaped cross-section, said bar having a generally planar ground engagement underside, a linear, acute-angled leading edge, and a rearwardly and upwardly curved heel section parallel with the leading edge and forming a rear limit of the underside, the underside being recessed at a transverse channel extending the entire length of the bar, said channel being parallel with the leading edge and being disposed between said leading edge and the heel section.

2. The show shovel scoop of claim 1, wherein the cross-section of the transverse channel is arcuate, the depth of the channel being at its maximum at a point which is offset towards the leading edge.

3. The snow shovel scoop of claim 1, wherein said heel section forms a downwardly protruding step-like joinder between the underside of the bar and that portion of the rear surface section which is adjacent to the bar, whereby the portion of the rear surface section adjacent to the transverse bar is maintained above the ground when the shovel is in use.

4. The snow shovel scoop of claim 1, wherein the cross-section of the transverse channel is arcuate, the depth of the channel being at its maximum at a point which is offset towards the leading edge.

5. A snow shovel comprising a scoop which includes a front face section, a rear surface section, two opposed side sections, a straight, transverse forward edge section and a generally transversely oriented rear edge section, the length of said forward edge section being greater than a maximum length of said scoop as measured between opposed points of the forward edge section and the rear edge section, the front face section having the configuration of a generally concave surface, said generally concave surface being concavely arched both in longitudinal direction and in transverse direction, said generally concave surface forming a major area of the front face section, the forward edge section including a transverse bar having a wedge-shaped cross-section, said bar having a generally planar ground engagement underside, a linear, acute-angled leading edge, and a rearwardly and upwardly curved heel section parallel with the leading edge and forming a rear limit of the underside, the underside being recessed at a transverse channel extending the entire length of the bar, said channel being parallel with the leading edge and being disposed between said leading edge and the heel section, said snow shovel further comprising elongated handle means fixedly secured to the scoop and extending rearwardly and upwardly away from the rear surface section when the shovel is in a working position with the front edge on the ground.

6. The snow shovel of claim 5, wherein the cross-section of the transverse channel is arcuate, the depth of the channel being at its maximum at a point which is offset towards the leading edge.

7. The snow shovel of claim 5, wherein said heel section forms a downwardly protruding step-like joinder between the underside of the bar and that portion of the rear surface section which is adjacent to the bar, whereby the portion of the rear surface section adjacent to the transverse bar is maintained above the ground when the shovel is in use.

8. The snow shovel of claim 5, wherein the cross-section of the transverse channel is arcuate, the depth of the channel being at its maximum at a point which is offset towards the leading edge.

9. A snow shovel comprising, in combination:

a) a scoop having a straight, transverse front edge portion, a transverse rear edge portion and two opposed side edge portions, said edge portions forming the periphery of a generally concavely rounded cavity defined by a front face portion of said scoop;

b) a handle fixedly secured to a rear surface of the scoop at a point generally centrally between said side edges;

c) said handle comprising a generally straight stem having a first end portion in coincidence with the rear surface of the scoop, a first hand grip section disposed generally centrally of the length of the stem, and a second end portion;

d) said second end portion of the stem having an angular extension which forms a second hand grip section extending in a rearward direction at an obtuse angle to the stem such that, with the shovel in said working position, the second hand grip section is disposed generally horizontally; said concavely rounded cavity determining an imaginary first centre of gravity which prevails when the cavity is empty; and said concavely rounded cavity further determining an imaginary second centre of gravity, which prevails when the cavity is loaded with snow piled up therein, said second centre of gravity being located at a level above the level of the first centre of gravity, said second centre of gravity being also disposed outside of the space bound by said cavity;

f) said first hand grip section and said second hand grip section being so disposed relative to each other and to the first and second centres of gravity that an imaginary line passing through the two grip portions extends between said two centres of gravity;

g) a transverse bar at the front edge portion, said bar having a wedge-shaped cross-section, a generally planar ground engagement underside, a linear, acute-angled leading edge, and a rearwardly and upwardly curved heel section parallel with the leading edge and forming a rear limit of the underside, the underside being recessed at a transverse channel extending the entire length of the bar, said channel being parallel with the leading edge and being disposed between said leading edge and the heel section.

10. The snow shovel of claim 9 wherein the cross-section of the transverse channel is arcuate, the depth of the channel being at its maximum at a point which is offset towards the leading edge.

11. The snow shovel of claim 9, wherein said heel section forms a downwardly protruding step-like joinder between the underside of the bar and that portion of the rear surface section which is adjacent to the bar, whereby the portion of the rear surface section adjacent to the transverse bar is maintained above the ground when the shovel is in use.

* * * * *